109-81 SR
12/31/85 OR 4,561,362

United States Patent [19]

Wildermuth

[11] Patent Number: 4,561,362

[45] Date of Patent: Dec. 31, 1985

[54] MOBILE-IMMOBILE SAFE

[76] Inventor: Wallace P. Wildermuth, Box 888, Lead, S. Dak. 57754

[21] Appl. No.: 160,734

[22] Filed: Jun. 18, 1980

[51] Int. Cl.[4] ..... E05G 1/02

[52] U.S. Cl. ..... 109/81; 109/29; 109/49.5

[58] Field of Search ..... 109/29, 49.5, 81, 80, 109/82, 84, 85

[56] References Cited

U.S. PATENT DOCUMENTS

| | | | |
|---|---|---|---|
| 79,808 | 7/1868 | Bryant | 109/29 |
| 131,842 | 10/1972 | Brook | 109/29 |
| 1,297,492 | 3/1919 | Rauwald | 109/29 |
| 1,463,498 | 7/1923 | Burgess | 109/81 |
| 2,829,608 | 4/1958 | Blackburn | 109/33 |

*Primary Examiner*—Reinaldo P. Machado
*Attorney, Agent, or Firm*—Cushman, Darby & Cushman

[57] ABSTRACT

A storage container, such as a safe, is provided with internal removable excess mass which renders the container relatively immobile until the mass is removed. The mass may be, for example, water stored between inner and outer walls of the container or lead shot, steel balls or anti freeze. Normal access to the mass for removal thereof, in order to render the container relatively mobile, is available only after the door of the container has been opened.

2 Claims, 1 Drawing Figure

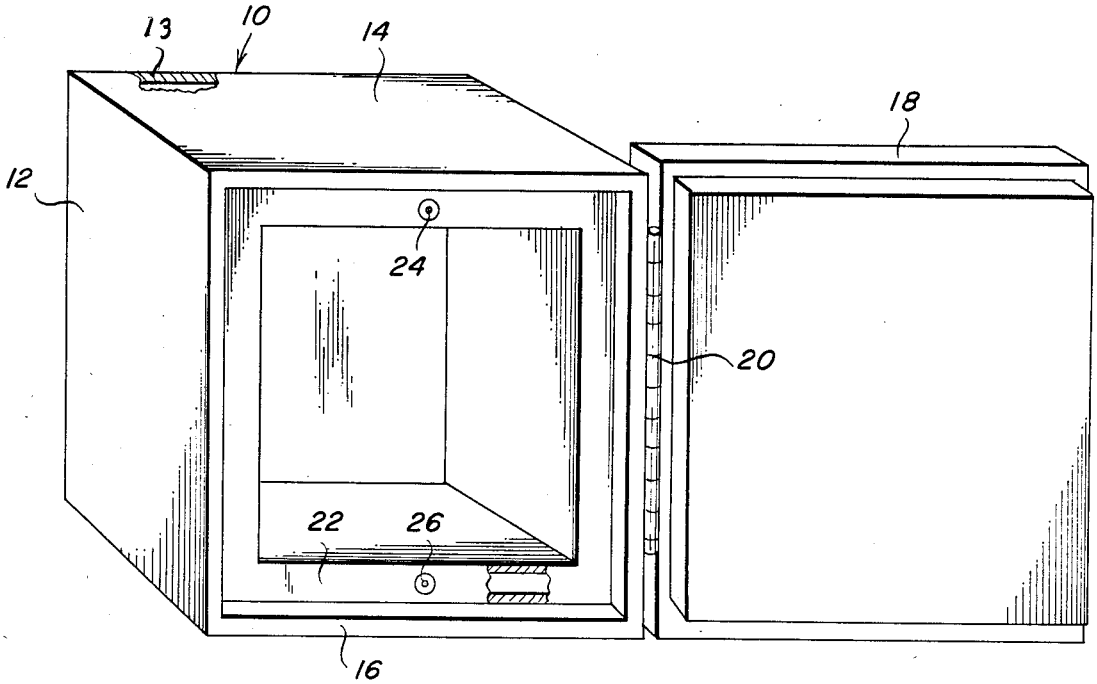
13
10
14
18
12
24
20
22
26
16

MOBILE-IMMOBILE SAFE

PRIOR ART

It has been proposed to place water in the walls of safes for the purpose of protecting the contents of these structures against fire damage. Such disclosures are set forth in U.S. Pat. Nos. 67,929, 79,808 and 2,829,608. U.S. Pat. No. 131,842 discloses a portable safe protector in the form of a double walled case adapted to be fitted around the outside of a safe, the space between the walls being filled with water for fire protection. With each of these known structures, the water chambers are accessible for filling and emptying from outside the casing.

BRIEF DESCRIPTION OF THE INVENTION

In accordance with the principles of this invention a normally portable or mobile safe or the like is rendered relatively non-portable or immobile, after it has been located in a desired spot, by adding excess weight to the interior of the safe in sufficient amount to make the safe too heavy for transport manually or by ordinary means. In a preferred embodiment, the walls of the casing forming the safe are provided with a chamber means adapted to be filled with a mass such as a liquid or small steel balls. The chamber means may include a single chamber, a plurality of separate chambers or a plurality of chambers interconnected with one another. Access to the chamber means for filling and emptying is available only when the door of the safe is open. After the safe is located where needed, and the chamber means has been filled with liquid, the safe is so heavy that it is relatively immovable, and yet when it must subsequently be moved, the liquid can be drained after opening the door of the safe so that the weight of the safe is reduced to render it easily transportable to another location. Access to the excess weight only when the door is open prevents unauthorized removal of the excess weight.

IN THE DRAWINGS

The FIGURE shows a perspective view of a preferred form of a safe or storage box that embodies this invention.

DETAILED DESCRIPTION

The safe or storage box 10 includes relatively impenetrable walls which completely surround an internal storage space, the walls including side walls 12, a back wall 13, a top wall 14, a bottom wall and a front wall 16. The front wall is provided with a secure door 18 hinged to the inside of a side wall so that the hinge means 20 is concealed when the door is closed to completely seal the contents within the storage space. The door may be provided with any suitable combination lock or other locking device for safely sealing the contents within the safe. The casing walls, top, bottom, and door means are all made and assembled from known steels or other material that is substantially tamperproof, as is known in the art. While such a casing may be well adapted to protect the contents of the safe against theft, relatively small sized casings, even though locked, may be sufficiently light to be transported by a thief to a location where forced entry into the safe can be made without fear of detection.

In accordance with the preferred form of this invention, in order to render the safe or strong box 10 less portable, most or all of the inside walls of the casing are constructed to have chamber means 22 integral therewith adapted for liquid storage. The chamber means forming an integral part of the inside walls of the casing may be formed as a single unit or a plurality of individual but interconnected chambers may be provided. The chamber or chambers are designed to be filled and emptied via a suitable access means. In the illustrated embodiment the chamber or chambers may be filled through an inlet 24 and may be drained of liquid through an outlet 26. The inlet and outlet are provided with suitable seals to hold the liquid sealed in the chamber means so as to add the weight of the liquid to the safe to make it relatively immovable and to allow the liquid to be removed by permitting the liquid to be drained when the safe is to be moved.

The access means is accessible only when the safe door is open. In the illustrated embodiment the inlet 24 and outlet 26 are located on the top and bottom sides of the front wall directly behind the door in positions that are entirely concealed within the safe when the door 18 is closed. The inlet 24 and outlet 26 are thus disposed so that they can be reached only when the door 18 is open. After the safe has been transported to its destination and after the chamber means 22 has been filled with the liquid, the safe remains relatively immovably positioned in that spot until the door 18 is opened and the chamber means is drained to lighten the safe and permit its removal to another location.

As indicated above, the liquid containing chamber means 22 may be made up of several separate interconnected chambers for convenience, that are attached to and are supported by the inside walls of the casing. When a plurality of chambers are assembled together within the casing, suitable piping interconnections can be made whereby to easily fill and drain all of the separate chambers through the common inlet 24 and outlet 26. Any available liquid may be filled into the chamber means to add weight to the safe. Water is the most conveniently available liquid but other liquids especially those denser than water can be used if available.

In place of chamber means 22, the inside walls of the chamber can be provided with suitable rack supporting means for receiving separable lead or other conveniently handled weight means. As many weights can be positioned on such racks as may be deemed desirable. It is apparent that such added weights positioned within the casing body and seated on racks attached to the inside walls of the casing, cannot be removed until door 18 is opened. Once the casing has been transported to its destination, it can easily be made immovable by simply adding more or less weights to the racks positioned within the body of the casing. Once loaded with the portable weights, the safe can be made portable again only by someone having knowledge of the combination lock or key to the door 18 of the strong box.

As an example of the preferred form of the structure, a 30" by 30" by 30" casing with a 3" thick hollow liquid retaining chamber means on the inside of 5 of the sides of the casing, will hold approximately 45 gallons of water. Thus, 360 pounds can be added to the weight of the safe by simply filling this chamber means 22 with water and sealing the concealed inlet and outlet ports. The casing on the other hand can be easily lightened for transport by draining the water from chamber means 22. But it is to be noted that the chamber means cannot be drained until door 18 is opened to expose inlet 24 and outlet 26 so that once in position and after the chamber means 22 is filled, the safe is rendered substantially immovable until prepared for transport by being drained by one having access through the unlocked door of the safe. Likewise as stated above, any weights stored on racks within the casing, inhibit the portability of the safe until these weights are removed after the door has been opened.

It is, of course, desirable to provide a pressure relief valve to permit any water or other liquid that may become vaporized to escape from the chamber storage means should the liquid tend to boil away under pressure as might happen during a fire. On the other hand, the use of water in a chamber so protected, tends to protect the contents of the safe from destruction as taught in the prior art. Any relief valve or vent means can be constructed and placed in such a position to prevent an unauthorized person from tampering with such a protective device to drain the chamber means.

The above description covers the preferred form of this invention. It is possible that modifications thereof may occur to those skilled in the art that will fall within the scope of the following claims.

What is claimed is:

1. A container for safe-keeping valuables and adapted to be selectively rendered relatively heavy and consequently relatively immobile and relatively light and consequently relatively portable, said container comprising a casing having inner and outer spaced-apart walls and a lockable door for providing access to a storage space within the casing when the door is open and for sealing the inside of the casing against access when the door is closed, the space between the inner and outer walls holding a removable mass of solid weight means, including a plurality of metal weights, sufficient to render the container relatively immobile, said door in its closed position blocking access to said solid weights means and in its open position permitting access to said solid weight means so that the latter may be removed to reduce the weight of the container and render the same relatively portable.

2. A container for safe-keeping valuables and adapted to be selectively rendered relatively heavy and consequently relatively immobile and relatively light and consequently relatively portable, said container comprising a casing having inner and outer spaced-apart walls and a lockable door for providing access to a storage space within the casing when the door is open and for sealing the inside of the casing against access when the door is closed, the space between the inner and outer walls holding a removable mass of solid weight means, including a plurality of metal balls, sufficient to render the container relatively immobile, said door in its closed position blocking access to said solid weight means and in its open position permitting access to said solid weight means so that the latter may be removed to reduce the weight of the container and render the same relatively portable.

* * * * *